US006445290B1

(12) United States Patent
Fingal et al.

(10) Patent No.: US 6,445,290 B1
(45) Date of Patent: Sep. 3, 2002

(54) REMOTE CONTROL MONITORING DEVICE

(76) Inventors: Simone A Fingal, 287 Clarkson Ave. apt. 8, Brooklyn, NY (US) 11276; Merlene U Percival, 287 Clarkson Ave. apt. 8, Brooklyn, NY (US) 11276

( * ) Notice: Subject to any disclaimer, the term of this patent is extended or adjusted under 35 U.S.C. 154(b) by 0 days.

(21) Appl. No.: 09/560,932

(22) Filed: Apr. 30, 2000

(51) Int. Cl.[7] ..... G08B 1/08; G08B 5/22

(52) U.S. Cl. ..... 340/539; 340/825.36; 340/825.49; 340/825.69; 348/734

(58) Field of Search ..... 340/539, 825.69, 340/825.72, 825.49, 825.36; 348/734

(56) References Cited

U.S. PATENT DOCUMENTS

| | | | | |
|---|---|---|---|---|
| 5,455,560 A | | 10/1995 | Owen | 340/539 |
| 5,598,143 A | | 1/1997 | Wentz | 340/539 |
| 5,673,035 A | | 9/1997 | Huang | 340/825.44 |
| 5,677,895 A | * | 10/1997 | Mankovitz | 348/734 |
| 5,686,891 A | | 11/1997 | Sacca et al. | 340/539 |
| 5,790,021 A | | 8/1998 | Mickel et al. | 340/539 |
| 5,939,981 A | * | 8/1999 | Renney | 340/539 |

* cited by examiner

*Primary Examiner*—Donnie L. Crosland
(74) *Attorney, Agent, or Firm*—Michael I. Kroll

(57) ABSTRACT

A remote control monitoring device for aiding a user in locating a remote control unit for an appliance. The remote control monitoring device includes an alarm signal transmitter for selectively generating and transmitting an alarm signal, a receiver connected to the remote control for receiving the alarm signal and an alarm signal generator connected to the receiver for generating an audible alarm signal upon receipt of the alarm signal by the receiver. The user is able to locate the remote control by moving to the source of the audible alarm signal. The alarm signal transmitter is connected to the appliance and an activation button for activating the alarm signal transmitter to generate and transmit the alarm signal is provided on the appliance. A cradle is provided connected to a side of the appliance for receiving the remote control therein. The cradle includes a connection wire for connection to a power source and a power terminal and the remote control includes a recharge terminal for connecting to the power terminal on the cradle for recharging a power source of the remote control.

9 Claims, 7 Drawing Sheets

REMOTE CONTROL MONITORING DEVICE

BACKGROUND OF THE INVENTION

1. Field of the Invention

The present invention relates generally to monitoring devices and, more specifically, to a device for determining the location of a remote control for an electronic device and alerting the user as to the location by generating an audible and/or visible alarm signal.

2. Description of the Prior Art

Numerous types of monitoring devices have been provided in the prior art. For example, U.S. Pat. Nos. 5,455,560; 5,598,143; 5,673,035; 5,686,891 and 5,790,021 all are illustrative of such prior art. While these units may be suitable for the particular purpose to which they address, they would not be as suitable for the purposes of the present invention as heretofore described.

U.S. Pat. No. 5,455,560

Inventor: C. Randal Owen

Issued: Oct. 3, 1995

A locating device for locating a remote control device which is capable of controlling an electronic device, the electronic device being stationary and the remote control device being capable of controlling the electronic device from a remote location, is disclosed. The locating device comprises a transmitter portion incorporated with the electronic device and a receiver portion which is located within the remote control device. The transmitter portion comprises circuitry for transmitting a signal. The receiver portion comprises a first oscillator circuit which is adapted to oscillate when the transmitted signal is at the design center frequency of the first oscillator circuit. The receiver portion further comprises a second oscillator circuit which is adapted to begin oscillation after the first oscillator circuit begins to oscillate. The signal from the second oscillator circuit is amplified and provided to an audio oscillator circuit. A method of coding the signals is also disclosed.

U.S. Pat. No. 5,598,143

Inventor: Jeff D. Wentz

Issued: Jan. 28, 1997

A system for changing the function of a television set through a fixedly positioned signal box and a hand held remote beeper and for locating a plurality of beepers if lost including a remote control signal box located at a television set for changing the functions of the television set; a plurality of hand held beepers operatively coupled to the signal box for allowing the functions of a television set to be remotely changed; an emitter in the signal box for sending out a corresponding electrical signal to each of the beepers; a receiver in each beeper for receiving such a corresponding electrical signal, whereupon beeping noises are produced for locating each beeper.

U.S. Pat. No. 5,673,035

Inventor: Dennis Huang

Issued: Sep. 30, 1997

A locator-paging system including a master kit and a plurality of sub kits, in which the master kit can be activated to transmit a searching signal to each sub kit, causing every sub kit to transmit an answering signal. The master kit generates a warning signal when at least one sub kit does not transmit an answer back. The master kit can also be actuated to transmit paging signals to the sub kits. As a result, the sub kits are actuated to generate a sound and light alarm when a paging signal from the master kit is recognized. Furthermore, the sub kits can be actuated to transmit a paging signal to the master kit which causes the master kit to generate a sound and light alarm, indicating which sub kit is calling.

U.S. Pat. No. 5,686,891

Inventor: Frank Sacca et al.

Issued: Nov. 11, 1997

A system for locating an object. The system includes an electronic device, a wireless transmitter for outputting a transmitted signal, and a receiver wherein one of the receiver or the transmitter is mounted within the electronic device and the other is positioned remote therefrom. The receiver comprises a wake up timer circuit for periodically generating a wake up signal, a wireless signal receiver being activated by the receipt of the wake up signal from the wake up timer circuit for generating a detect signal when the wireless signal receiver circuit receives the transmitted signal from the transmitter; and an audible signal generator circuit for generating an audible signal upon receipt of the detect signal from the wireless signal receiver circuit. The wake up timer circuit and the wireless signal receiver circuit are disabled when the audible signal generator circuit generates the audible signal.

U.S. Pat. No. 5,790,021

Inventor: Ivor Mickel et al.

Issued: Aug. 4, 1998

A remote control holder includes a platform having two opposing long sides. A wall is disposed along each of the long sides and extends upwardly from the platform. Each wall includes a padded structure disposed along an inward facing surface thereof. The padded structure includes a flexible cover thereon. A first switch is disposed within one of the padded structures adjacent the cover. A remote control unit is of sufficient width for the remote control unit to depress the first switch by urging against the padded structures and the first switch when the remote control unit is placed on the platform with the bottom broad surface parallel to and touching the platform. The first switch is connected to a first power source and a timer circuit. The timer circuit is connected to a transmitter and configured to control the operation thereof. The remote control unit includes a second power source connected to a receiver, and the receiver connected to a sound generating circuit.

SUMMARY OF THE PRESENT INVENTION

The present invention relates generally to monitoring devices and, more specifically, to a device for determining the location of a remote control unit for an electronic device and alerting the user as to the location of the remote control unit by controlling the remote control unit to generate an audible alarm signal.

A primary object of the present invention is to provide a remote control monitoring device that will overcome the shortcomings of prior art devices.

Another object of the present invention is to provide a remote control monitoring device which is able to aid a user of electronic equipment in finding a misplaced remote control.

A further object of the present invention is to provide a remote control monitoring device including a transmitting device located within the electronic equipment and a receiver device located in the remote control unit.

A yet further object of the present invention is to provide a remote control monitoring device wherein activation of the transmitting device causes a signal to be transmitted to the receiver device and activates an audible alarm within the remote control device.

A still further object of the present invention is to provide a remote control monitoring device including recharge terminals for receiving power from a cradle within which the remote control unit may be stored, the power being provided to recharge the remote control device.

Another object of the present invention is to provide a remote control monitoring device that is simple and easy to use.

A still further object of the present invention is to provide a remote control monitoring device that is economical in cost to manufacture.

Additional objects of the present invention will appear as the description proceeds.

A remote control monitoring device for aiding a user in locating a remote control unit for an appliance is disclosed by the present invention. The remote control monitoring device includes an alarm signal transmitter for selectively generating and transmitting an alarm signal, a receiver connected to the remote control for receiving the alarm signal and an alarm signal generator connected to the receiver for generating an audible alarm signal upon receipt of the alarm signal by the receiver. The user is able to locate the remote control by moving to the source of the audible alarm signal. The alarm signal transmitter is connected to the appliance and an activation button for activating the alarm signal transmitter to generate and transmit the alarm signal is provided on the appliance. A cradle is provided connected to a side of the appliance for receiving the remote control therein. The cradle includes a connection wire for connection to a power source and a power terminal and the remote control includes a recharge terminal for connecting to the power terminal on the cradle for recharging a power source of the remote control.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views.

DESCRIPTION OF THE REFERENCED NUMERALS

Figure 1:
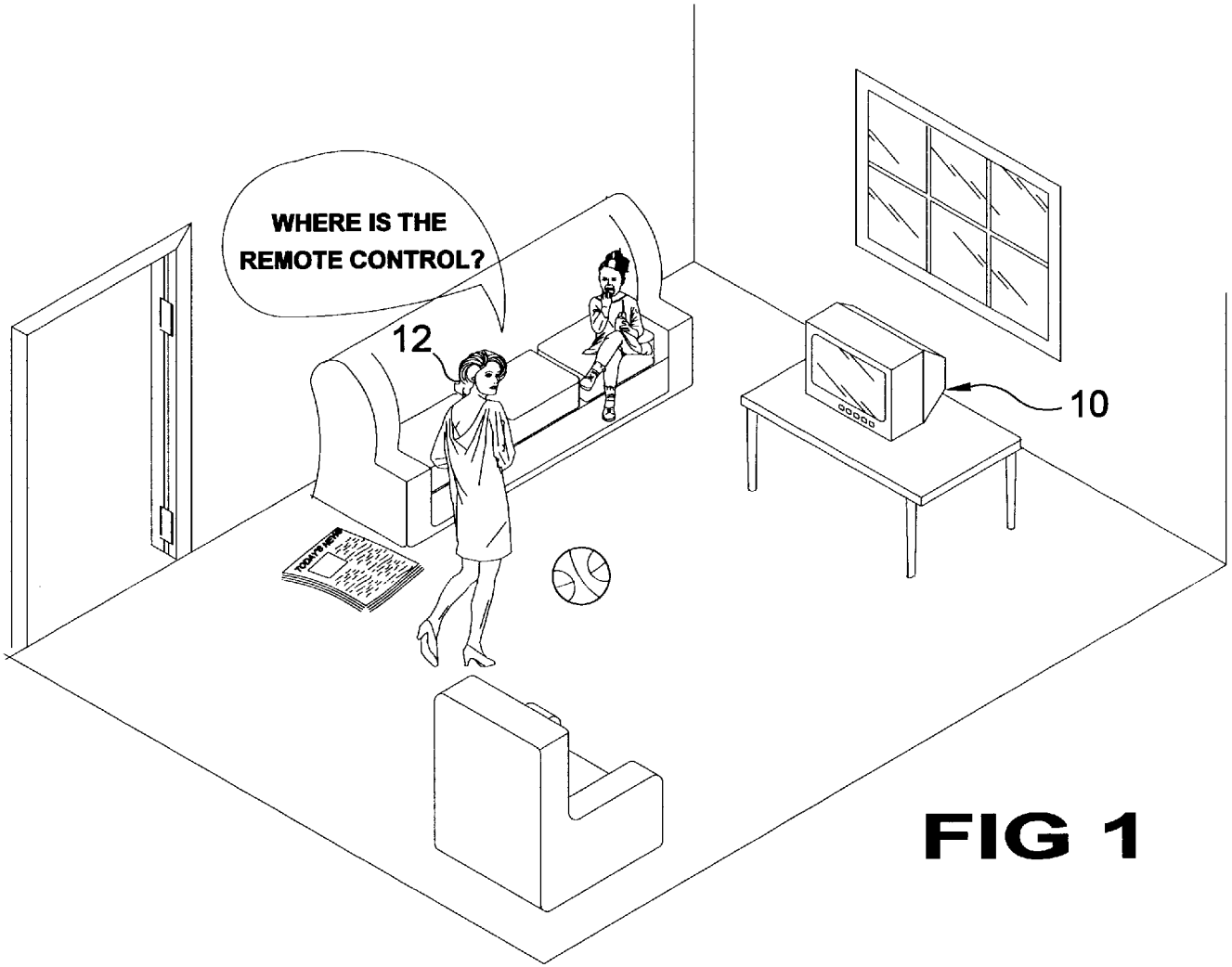
FIG. 1 is a top perspective view of a person searching for a misplaced remote control device.

Turning now descriptively to the drawings, in which similar reference characters denote similar elements throughout the several views, the Figures illustrate the remote control monitoring device of the present invention. With regard to the reference numerals used, the following numbering is used throughout the various drawing figures.

10 conventional television set
12 person searching for a remote control device for activating the television set
14 remote control monitoring device of the present invention
16 television including the remote control monitoring device
18 speaker of television
20 infrared receiver of television
22 power button of television
24 channel up button of television
26 channel down button of television
28 volume up button of television
30 volume down button of television
32 activation button of remote control monitoring device
34 remote control device of remote control monitoring device
36 cradle for storing remote control device
38 person activating activation button of remote control monitoring device
40 audible signal generated by remote control device
42 control buttons on remote control device
44 power button on remote control device
46 speaker on remote control device
48 power cord for supplying power to cradle for charging remote control device
49 plug
50 recharge terminals on remote control device for receiving power from cradle
52 recharge terminals for supplying power to remote control device
54 processor of remote control device
56 transmitter of remote control device
58 receiver of remote control device
60 audible alarm generator of remote control device
62 power storage unit of remote control device
64 memory of remote control device
66 standby power supply of electrical device
67 alarm signal generator
68 transmitter of electrical device

DETAILED DESCRIPTION OF THE PREFERRED EMBODIMENT

Turning now descriptively to the drawings, in which similar reference characters denote similar elements throughout the several views, FIG. 1 illustrates a common problem for most people who own television sets 10 and other appliances controlled by remote control units. As can be seen from this figure, a person 12 is searching for the remote control of the television set 10. Conventional remote controls are easily misplaced and due to their compact size can be difficult to find. For example, the remote control can fall between the cushions of the sofa 11 or maybe even under the sofa 11 and thereby be difficult to locate. Furthermore, due to its size it can be taken and chewed on by a child or pet and thus difficult to locate or possibly harmful. The remote control monitoring device of the present invention is provided to aid a user in locating a remote control unit at any desired time.

Figure 2:
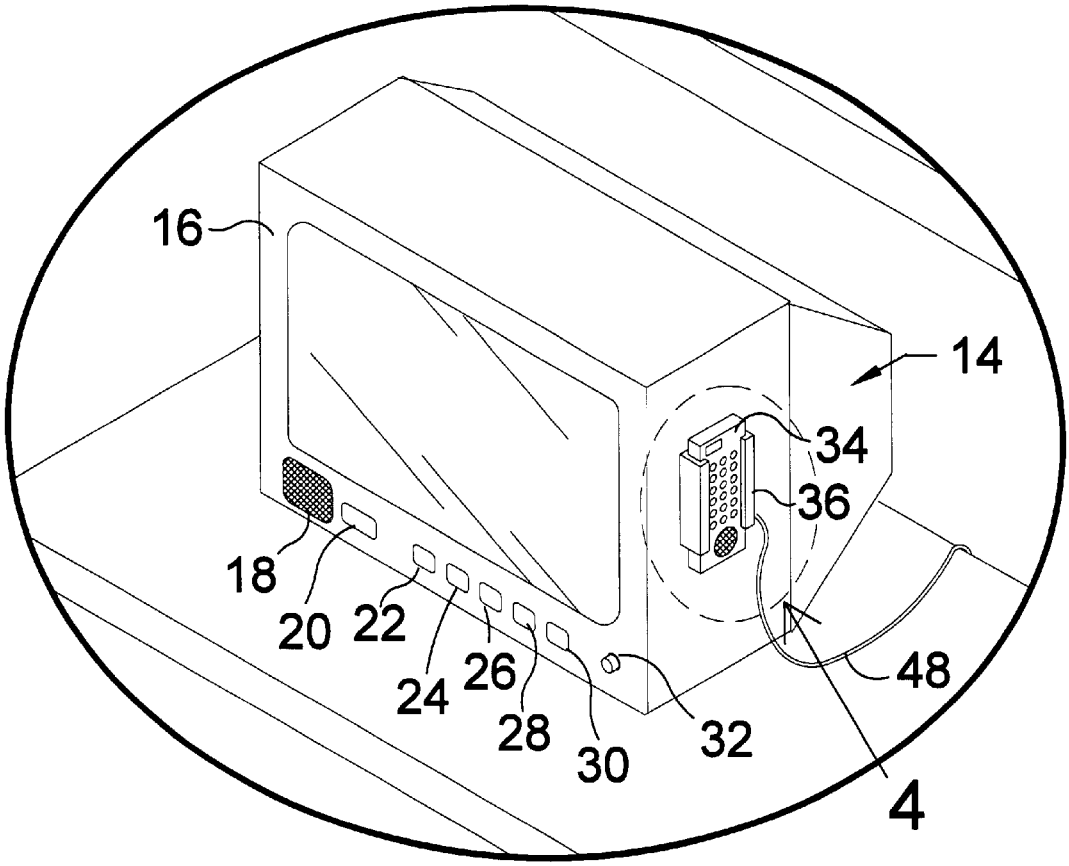
FIG. 2 is a perspective view of a television including the remote control monitoring device of the present invention.

FIGS. 2 through 7 illustrate the remote control monitoring device of the present invention indicated generally by the numeral 14 for assisting a user in locating the remote control 34 when it is misplaced. FIG. 2 illustrates the remote control monitoring device 14 of the present invention for use with a television set 16. The television set 16 can be any conventional television set 16 which uses a remote control 34 for adjusting or changing certain settings on the television set 16 such as the channel, the volume and the picture quality. The television set 16 would normally include a speaker 18 through which audio signals are transmitted and an infrared receiver 20 for receiving infrared signals transmitted by the remote control 34. Certain operational buttons are also normally found on the television set 16 for manually controlling the operation thereof. Such buttons include but are not limited to a power button 22 for turning the television set on or off, a channel up button 24 and channel down button 26 for scanning through the available channels one at a time, and a volume up button 28 and a volume down button 30 for adjusting the volume of the television set 16.

The remote control monitoring device 14 includes a remote control 34 and a cradle 36 within which the remote control 34 will be positioned when not in use. The cradle 36 is secured to a television set 16 and may connect to an electrical outlet via a connection wire 48 for supplying power to the remote control 34 and thereby recharge the batteries thereof when seated in the cradle 36. An activation button 32 is provided on the television set 16 for activating the monitoring function of the remote control monitoring device 14.

Figure 3:
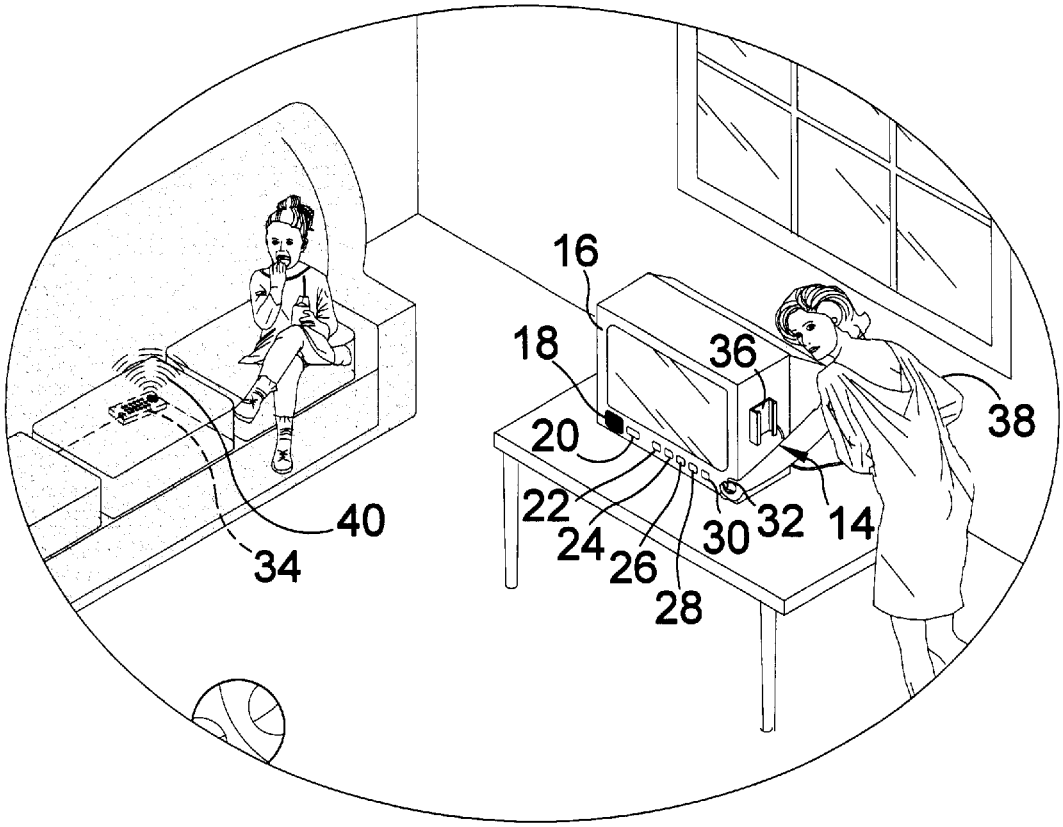
FIG. 3 is a perspective view of a user activating the remote control monitoring device of the present invention to cause the remote control device to generate an audible alarm.

FIG. 3 illustrates a user 38 activating the activation button 32 in order to determine the location of the remote control 34. As can be seen from the figure, the remote control 34 has been removed from the cradle 36 and is positioned at a location away from the television set 16. When the user 38 activates the activation button 32 a signal is caused to be transmitted to the remote control 34. Upon receipt of the signal by the remote control 34, the remote control 34 will generate an audible signal indicated generally by the arced lines labeled with the numeral 40. When the user 38 hears the audible signal, the location of the remote control 34 can be determined by moving towards the source of the audible signal.

Figure 4:
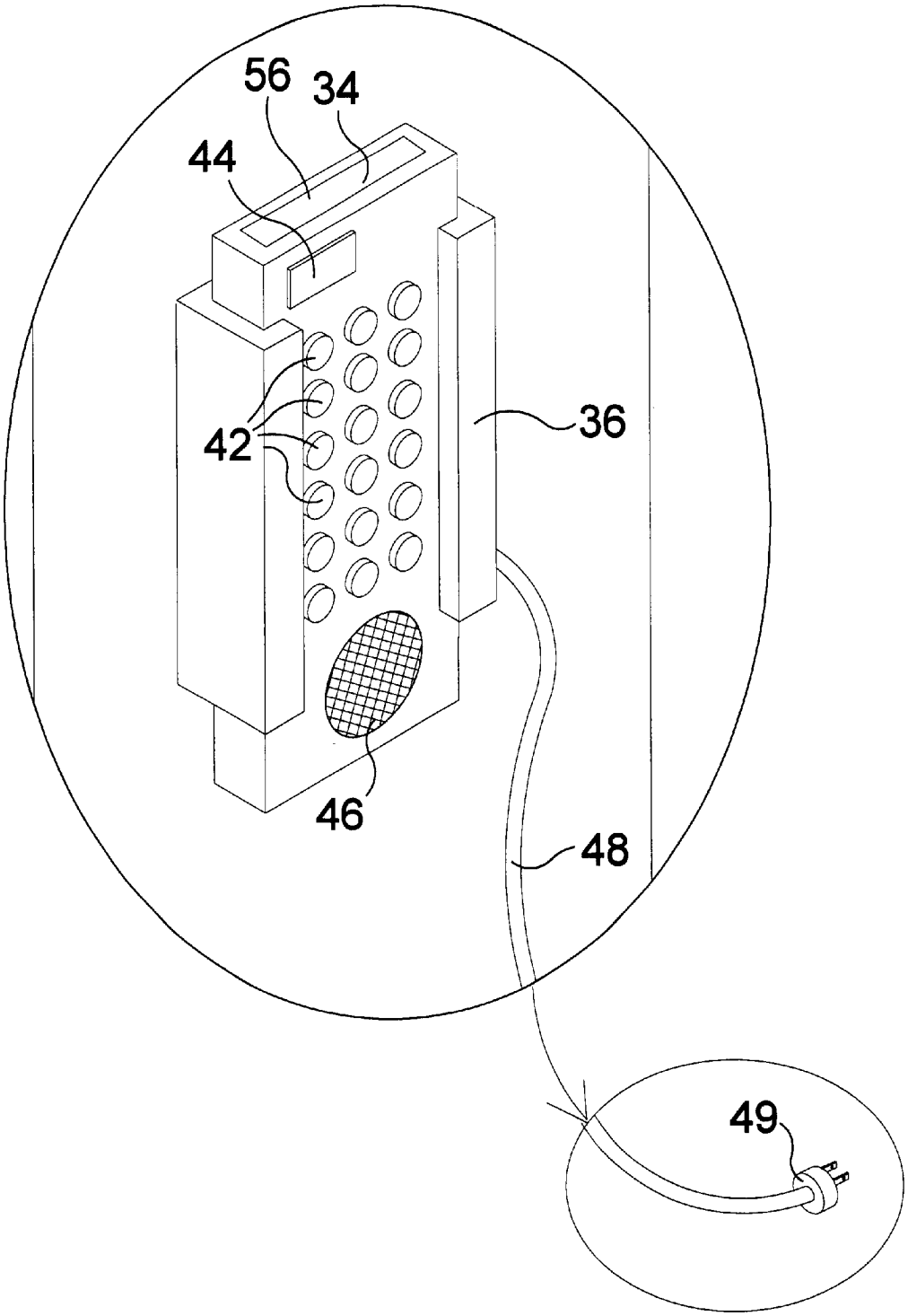
FIG. 4 is a top perspective view of the remote control device positioned within its storage cradle of the remote control monitoring device of the present invention.

An enlarged view of the remote control 34 and cradle 36 is illustrated in FIG. 4. As can be seen from this figure, the remote control 34 is positioned seated within the cradle 36. The connection wire 48 is connected to the cradle 36 and includes a plug 49 at an opposite end of the connection to the cradle 36 for connection to a power source such as a conventional wall outlet. The remote control 34 includes a plurality of function keys 42 similar to that of a conventional remote control for controlling the operations of the television set 16. Included with the plurality of control buttons 42 is a power button 44. Positioned on a front side of the remote control 34 is a transmitter 47 for transmitting control signals to the television set 16 upon activation of any of the plurality of control buttons 42. A speaker 46 is also provided on a side of the remote control 34 for producing the audible alarm signal when the activation button 32 on the television set 16 is activated by a user.

Figure 5:
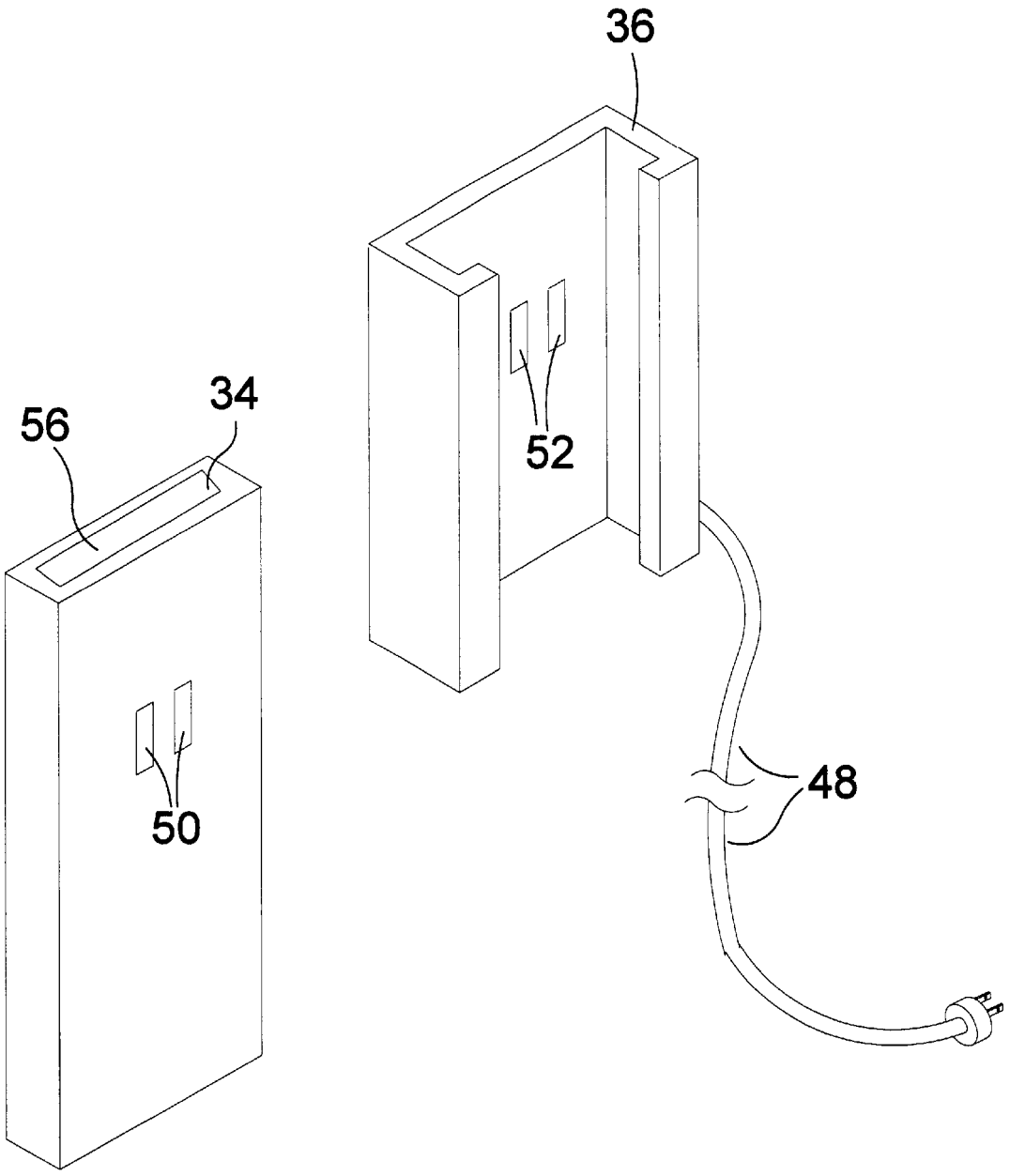
FIG. 5 is a back perspective view of the remote control device removed from the storage cradle of the remote control monitoring device of the present invention.

FIG. 5 illustrates the cradle 36 and a back side of the remote control 34. As can be seen, a pair of recharge terminals 50 are provided on the back side of the remote control 34. A matching pair of power terminals 52 are provided within the cradle 36. When the remote control is seated within the cradle 36, the pair of recharge terminals 50 are aligned with the pair of power terminals 52 for establishing a connection therebetween. Power is supplied to the pair of recharge terminals 50 through the pair of power terminals for recharging the batteries of the remote control 34 from a source of power via the electrical connection wire 48.

Figure 6:
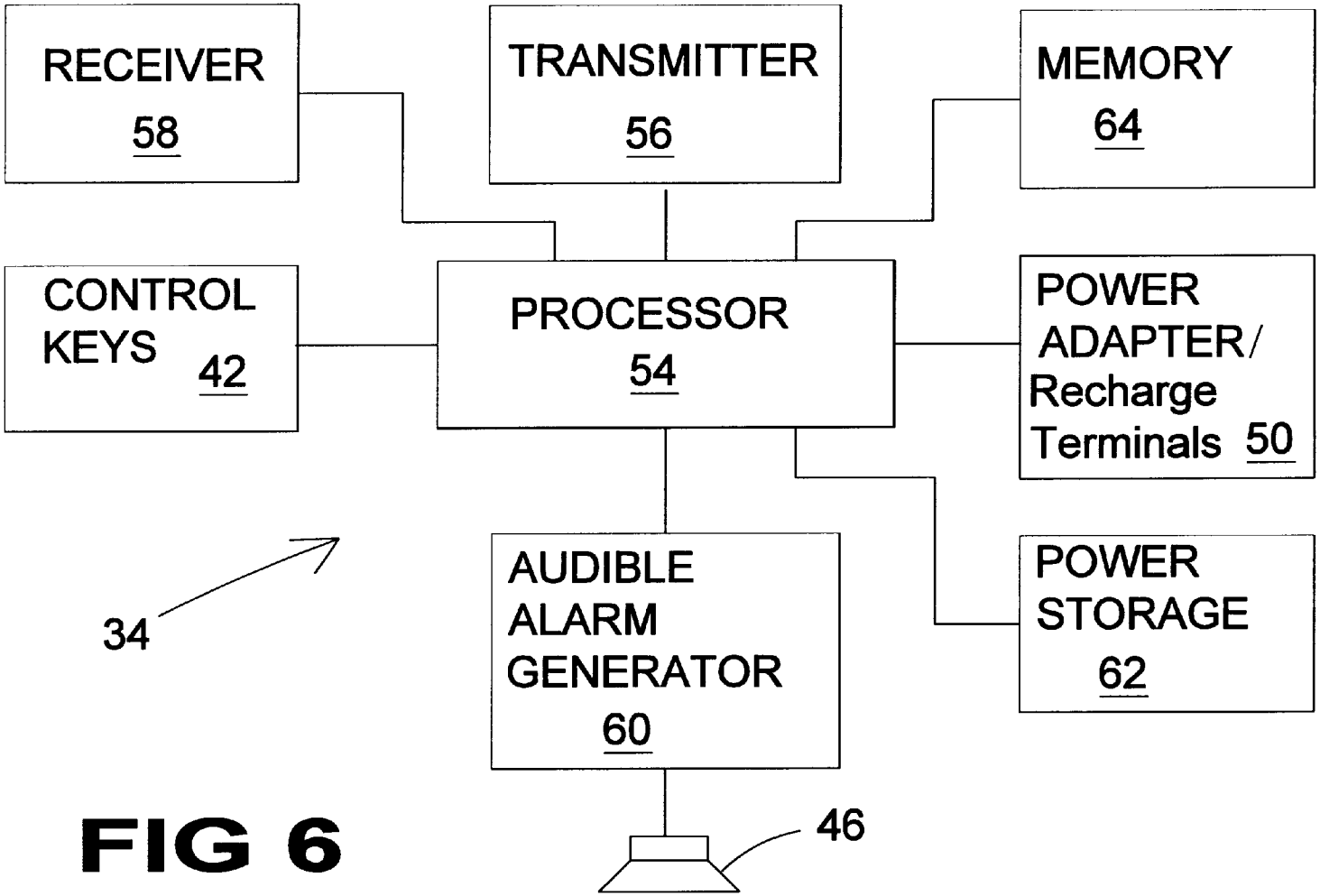
FIG. 6 is a block diagram of the remote control of the remote control monitoring device of the present invention.

A block diagram illustrating the internal components of the remote control 34 is illustrated in FIG. 6. The remote control 34 includes a processor 54 for controlling the operation thereof. The recharge terminals 50 are connected to a power storage/supply 62 for providing power to the power storage/supply 62 when the remote control 34 is positioned within the cradle 36. The power storage/supply 62 is connected to the processor 54 for supplying power thereto. The control keys 42 and the transmitter 56 are also connected to the processor 54. When any of the control keys 42 are activated a signal indicative of the activated control key is provided to the processor 54. The processor 54 analyzes the received signal and controls the transmitter 56 to transmit a signal indicative of the activated control key 42 for receipt by and controlling of the television set 16. A memory 64 is connected to the processor 54 for storing the command signal codes having a unique bit sequence for each control key 42. When a control key 42 is activated, the processor 54 retrieves the command signal code from the memory 64 and activates the transmitter 56 to transmit a signal having the retrieved bit sequence for receipt by the television set 16. A receiver 58 for receiving the alarm signal from the television set 16 when the activation button 32 is activated is provided and connected to the processor 54. When the alarm signal is received, the processor 54 will provide a signal to an audible alarm generator 60 connected thereto causing the audible alarm signal to be generated. The audible alarm generator 60 is connected to the speaker 46 for producing the audible alarm signal thus enabling a user to hear the signal and locate the remote control by moving towards the alarm signal.

Figure 7:
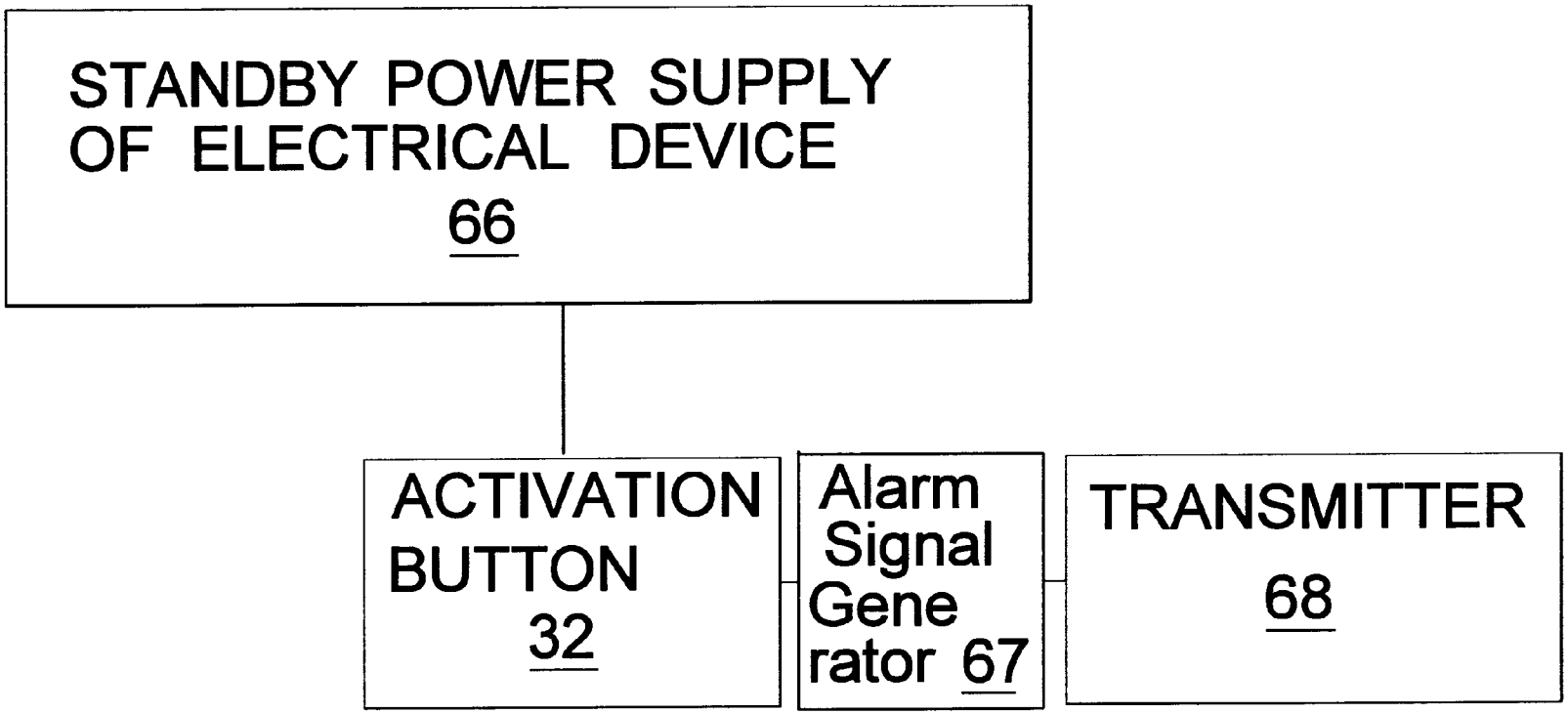
FIG. 7 is a block diagram of the transmitter of the remote control monitoring device of the present invention located within the electrical device.

A block diagram of the internal elements for activation of the remote control monitoring device 14 found within the television set or any other electrical appliance using a remote control and incorporating the remote control monitoring device 14 of the present invention is shown in FIG. 7. The activation button 32 is connected between a power supply of the electronic appliance 66 and an alarm signal generator 67. When the activation button 32 is activated, power is provided to the alarm signal generator 67 from the power supply 66 causing an alarm signal to be generated. A transmitter 68 is connected to the alarm signal generator 67 and transmits an alarm signal to the remote control 34 upon activation of the activation button 32. This alarm signal will be received by the receiver 58 of the remote control 34 for generating an audible alarm signal.

The operation of the remote control monitoring device 10 will now be described with reference to the figures. In operation, the remote control monitoring device 10 is provided with the cradle 36 secured to a side of an appliance. The power connection wire 48 of the cradle 36 may be connected to a source of power such as a conventional electrical outlet. The remote control 34 is able to be seated within the cradle 36. When seated in the cradle 36, the power terminals 52 of the cradle 36 for recharging the power source of the remote control 34.

When in use, the remote control 34 is removed from the cradle 36 and retained by a user for controlling the appliance. When finished using the appliance, the remote control 34 is frequently left by the user in a place other than in the cradle 36. By not replacing the remote control 34 in the cradle 36, a subsequent user of the appliance may have difficulty locating the remote control 34. If a subsequent user is unable to locate the remote control 34, the user will activate the activation button 32 on the appliance. Activation of this button 32 will cause an alarm signal to be generated at the appliance. The alarm signal will be transmitted by the appliance into the area therearound.

The remote control 34 includes a receiver 58 for receiving the alarm signal transmitted by the appliance. When the receiver 58 receives the alarm signal it generates an audible alarm signal which is produced through a speaker 46. The user is then able to locate the remote control by moving towards the origin of the alarm signal.

From the above description it can be seen that the remote control monitoring device of the present invention is able to overcome the shortcomings of prior art devices by providing a remote control monitoring device which is able to. Furthermore, the remote control monitoring device of the present invention is simple and easy to use and economical in cost to manufacture.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A remote control monitoring device for aiding a user in locating a remote control for an audio or video appliance, said remote control monitoring device comprising:

a) a cradle mounted on a side of said appliance, said cradle having an alarm signal transmitter for selectively generating and transmitting an alarm signal, said cradle adapted to receive said remote control and recharge a battery within said remote control and having a source of electric power separate from that of said appliance;

b) a receiver in said remote control for receiving the alarm signal;

c) an audible alarm signal generator and speaker connected to said receiver in said remote control for generating an audible alarm signal upon receipt of said alarm signal by said receiver, wherein the user is able to locate the remote control by moving to the source of the audible alarm signal; and d) an activation button directly on said appliance connected to standby power of said appliance for activating said alarm signal transmitter to generate and transmit said alarm signal.

2. The remote control monitoring device as recited in claim 1, wherein said alarm signal transmitter is connected to the appliance and said device further includes an activation button for activating said alarm signal transmitter to generate and transmit said alarm signal.

3. The remote control monitoring device as recited in claim 1, further comprising a cradle connected to a side of said appliance for receiving the remote control therein.

4. The remote control monitoring device as recited in claim 3, wherein said cradle includes a connection wire for connection to a power source and a power terminal.

5. The remote control monitoring device as recited in claim 4, further comprising a recharge terminal on the remote control for connecting to said power terminal of said cradle for recharging a power source of the remote control.

6. The remote control monitoring device as recited in claim 2, wherein said activation button is connected to a standby power supply of the appliance.

7. The remote control monitoring device as recited in claim 6, wherein said alarm signal transmitter includes an alarm signal generator for generating an alarm signal, wherein activation of said activation button connects said alarm signal generator to the power supply of the appliance causing said alarm signal generator to generate the alarm signal.

8. The remote control monitoring device as recited in claim 1, wherein said audible alarm signal generator includes a speaker for producing the audible alarm signal.

9. A remote control for and in combination with an audio or video appliance, comprising:

a) a cradle having legs forming a u-shape with bent ends to form a partial enclosure mounted on a side of said appliance for storing said remote control within said enclosure when not in use and recharging a battery within said remote control and mating electrical contacts on a back of said remote control and on said cradle within said enclosure;

b) means providing a source of electric power to said cradle independent of the source of electric power for said appliance;

c) said cradle having an alarm signal transmitter for generating and transmitting an alarm signal;

d) a receiver in said remote control for receiving the alarm signal;

e) an audible alarm signal generator and speaker connected to said receiver in said remote control for generating an audible alarm signal upon receipt of said alarm signal by said receiver;

f) an activation button directly on said appliance connected to a standby power supply of the appliance for activating said alarm signal transmitter to generate and transmit said alarm signal whereby the user is able to locate the remote control by moving to the source of the audible alarm signal.

* * * * *